US010788024B2

(12) United States Patent
Kakino et al.

(10) Patent No.: US 10,788,024 B2
(45) Date of Patent: Sep. 29, 2020

(54) FLUID PRESSURE PUMP

(71) Applicant: MITSUBISHI HEAVY INDUSTRIES, LTD., Tokyo (JP)

(72) Inventors: Atsushi Kakino, Tokyo (JP); Takashi Miura, Tokyo (JP); Kenta Kawasaki, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 161 days.

(21) Appl. No.: 14/387,947

(22) PCT Filed: Mar. 26, 2013

(86) PCT No.: PCT/JP2013/058832
§ 371 (c)(1),
(2) Date: Sep. 25, 2014

(87) PCT Pub. No.: WO2013/146802
PCT Pub. Date: Oct. 3, 2013

(65) Prior Publication Data

US 2015/0078930 A1 Mar. 19, 2015

(30) Foreign Application Priority Data

Mar. 30, 2012 (JP) ..... 2012-080136

(51) Int. Cl.
*F04B 1/20* (2020.01)
*F04B 1/22* (2006.01)
(Continued)

(52) U.S. Cl.
CPC ..... *F04B 1/2042* (2013.01); *F04B 1/2021* (2013.01); *F04B 1/22* (2013.01)

(58) Field of Classification Search
CPC ..... F04B 1/2042; F04B 1/2041; F04B 1/22; F04B 1/2025
(Continued)

(56) References Cited

U.S. PATENT DOCUMENTS 2,972,962 A * 2/1961 Douglas ..... F01B 3/0052 384/307
3,181,475 A 5/1965 Thompson
(Continued)

FOREIGN PATENT DOCUMENTS

DE 196 33 529 2/1998
DE 19633529 A1 * 2/1998 ..... F04B 1/2042
(Continued)

OTHER PUBLICATIONS

English Translation of JP 63-259172 A, Oct. 1988, obtained Oct. 6, 2016.*
(Continued)

*Primary Examiner* — Connor J Tremarche
(74) *Attorney, Agent, or Firm* — Wenderoth, Lind & Ponack, L.L.P.

(57) ABSTRACT

Ports (11 and 12) are formed in a port plate (10). A plurality of valve plate holes are arranged on a circumference around the rotation axis (S). The port plate (10) includes a plurality of bridges (13) configured to divide the port (11) into a circumferential direction to provide a plurality of port holes (11*a*), and a plurality of bridges (14) configured to divide the port (12) into the circumferential direction to provide a plurality of port holes (12*a*). A summation of the number of port holes (11*a*) and the number of port holes (12*a*) is greater than the number of valve plate holes.

4 Claims, 4 Drawing Sheets

(51) Int. Cl.
*F04B 1/2042* (2020.01)
*F04B 1/2021* (2020.01)

(58) Field of Classification Search
USPC ..... 417/269
See application file for complete search history.

(56) References Cited

U.S. PATENT DOCUMENTS

| | | | | |
|---|---|---|---|---|
| 3,249,061 | A * | 5/1966 | Ricketts | F01B 3/0055 91/486 |
| 3,585,901 | A * | 6/1971 | Moon, Jr. | F04B 1/2021 417/312 |
| 3,808,950 | A * | 5/1974 | Davies | F04B 1/2035 91/487 |
| 2008/0307956 | A1 | 12/2008 | Wright | |
| 2013/0055888 | A1 | 3/2013 | Ohno et al. | |

FOREIGN PATENT DOCUMENTS

| | | | | |
|---|---|---|---|---|
| EP | 0 661 451 | | 7/1995 | |
| EP | 0661451 | A1 * | 7/1995 | F04B 1/2042 |
| EP | 0 935 069 | | 8/1999 | |
| JP | 63-259172 | | 10/1988 | |
| JP | 63-259172 | A * | 10/1988 | |
| JP | 3547900 | | 7/2004 | |
| JP | 2007-077832 | | 3/2007 | |
| JP | 2008-309154 | | 12/2008 | |
| JP | 2011-214429 | | 10/2011 | |

OTHER PUBLICATIONS

English Translation of DE 19633529 (Lemmen) provided by the Applicant on Mar. 11, 2016 (Year: 2016).*

International Preliminary Report on Patentability and Written Opinion of the International Searching Authority dated Oct. 1, 2014 in corresponding International (PCT) Application No. PCT/JP2013/058832.

Extended European Search Report dated Jan. 5, 2016 in corresponding European Application No. 13767896.7.

International Search Report dated Jun. 25, 2013 in International (PCT) Application No. PCT/JP2013/058832.

Japanese Office Action dated Dec. 22, 2015 in corresponding Japanese Patent Application No. 2012-080136 (English translation).

* cited by examiner

FLUID PRESSURE PUMP

TECHNICAL FIELD

The present invention is related to a fluid pressure pump, for example, an axial piston type fluid pressure pump. This application claims a priority based on Japanese Patent Application No. JP 2012-080136 filed on Mar. 30, 2012, the disclosure of which is incorporated herein by reference.

BACKGROUND ART

Patent Literature 1 discloses a conventional axial piston type hydraulic pump. The axial piston type hydraulic pump is composed of a cylinder block in which a plurality of cylinders are provided, a plurality of pistons arranged in the plurality of cylinders to be slidable, and a valve plate. A cylinder port is formed in the cylinder block to be connected with the cylinder and to have an opening on a sliding surface of the cylinder block. The valve plate has a sliding surface which faces the sliding surface of the cylinder block and a back surface opposite to the sliding surface. A suction port and a discharge port are provided in the valve plate. The discharge port branches to three discharge holes on the side of the back.

Citation List

[Patent Literature 1] Japanese Patent 3,547,900

SUMMARY OF THE INVENTION

An object of the present invention is to reduce a pressure loss in a fluid pressure pump.

In an aspect of the present invention, a fluid pressure pump includes: a port plate having a first port and a second port, one of which functions as a suction port and the other of which functions as a discharge port; and a piston unit. The port plate and the piston unit are rotated relatively around a rotation axis. The piston unit includes a barrel in which a plurality of cylinders are formed; a plurality of pistons configured to carry out a reciprocating motion in the plurality of cylinders, respectively; and a valve plate in which a plurality of valve plate holes are formed to be respectively connected with the plurality of cylinders. The plurality of valve plate holes are arranged on a circumference around the rotation axis, and each of the first port and the second port is formed to have an arc shape around the rotation axis. The port plate includes a plurality of first bridges configured to divide the first port in a circumferential direction to provide a plurality of first port holes; and a plurality of second bridges configured to divide the second port in the circumferential direction to provide a plurality of second port holes. A summation of the number of first port holes and the number of second port holes is greater than the number of valve plate holes.

Because the summation of the number of first port holes and the number of second port holes is greater than the number of valve plate holes, the number of first bridges and the number of second bridges are great. Therefore, the width of the first bridge and the width of the second bridge can be made narrow. Thus, a pressure loss is reduced.

It is desirable that the number of first port holes and the number of second port holes are equal to each other.

In a second aspect of the present invention, a fluid pressure pump includes: a port plate having a first port and a second port, one of which functions as a suction port and the other of which functions as a discharge port; and a piston unit. The port plate and the piston unit rotate relatively around a rotation axis. The piston unit includes: a barrel having a plurality of cylinders; a plurality of pistons configured to carry out a reciprocating motion in the plurality of cylinders respectively; and a valve plate having a plurality of valve plate holes formed to be connected with the plurality of cylinders, respectively. The plurality of valve plate holes are arranged on a circumference around the rotation axis, and each of the first port and the second port is formed to have an arc shape around the rotation axis. The port plate includes: a plurality of first bridges configured to divide the first port in a circumferential direction to provide a plurality of first port holes; and a plurality of second bridges configured to divide the second port in the circumferential direction to provide a plurality of second port holes. An optional one of the plurality of valve plate holes is referred to as an optional valve plate hole. A first area as an area of the plurality of first bridges which overlaps with the optional valve plate hole changes based on the relative rotation of the piston unit and the port plate around the rotation axis in a view parallel to the rotation axis, and a second area as an area of the plurality of second bridges which overlaps with the optional valve plate hole changes based on the relative rotation. A quotient when a maximum value of the first area is divided by the area of the optional valve plate hole and a quotient when a maximum value of the second area divided by the area of the optional valve plate hole are both smaller than 0.65.

Because the quotient when the maximum value of the first area is divided by the area of the optional valve plate hole and the quotient when the maximum value of the second area divided by the area of the optional valve plate hole are small, the pressure loss is reduced.

It is desirable that the quotient when the maximum value of the first area is divided by the area of the optional valve plate hole and the quotient when the maximum value of the second area divided by the area of the optional valve plate hole are equal to each other.

According to the present invention, the pressure loss in the fluid pressure pump is reduced.

BRIEF DESCRIPTION OF THE DRAWINGS

The above object, the other objects, the effect, and the features of the present invention would become clearer from the description of the embodiments made in the conjunction with the attached drawings.

DESCRIPTION OF THE EMBODIMENTS

Hereinafter, a fluid pressure pump according to the present invention will be described with reference to the attached drawings.

First Embodiment

Figure 1:
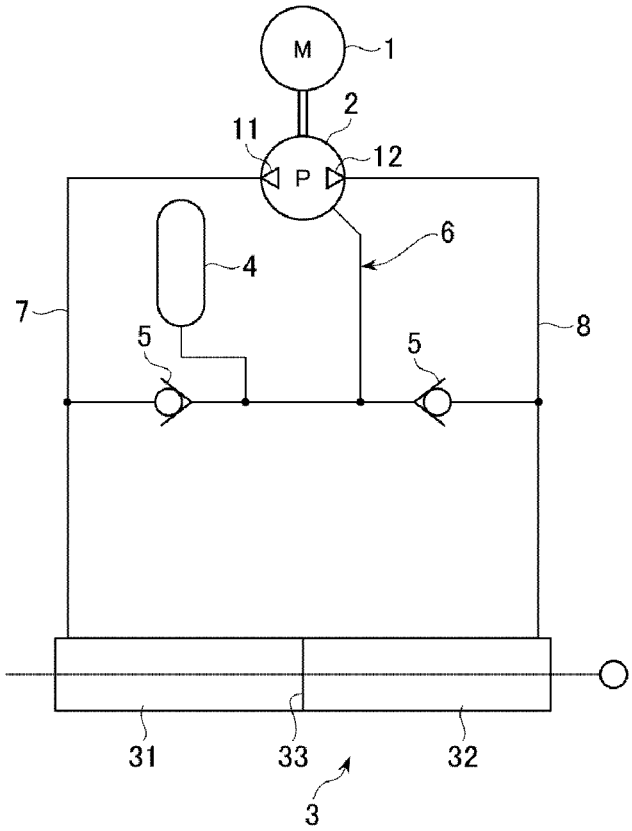
FIG. 1 is a diagram schematically showing a fluid pressure actuator having a fluid pressure pump according to a first embodiment of the present invention.

Referring to FIG. 1, a fluid pressure actuator having a fluid pressure pump according to a first embodiment of the present invention will be described. For example, the fluid pressure actuator such as a fluid pressure actuator 100 is an EHA (Electro-Hydrostatic Actuator) which is used for a flight control system of an aircraft. The fluid pressure actuator 100 contains an electric motor 1, a fluid pressure pump 2, an output cylinder 3, a return channel 6, a first output cylinder passage 7 and a second output cylinder passage 8.

The output cylinder 3 has a first output cylinder chamber 31, a second output cylinder chamber 32 and an output piston 33 arranged between the first output cylinder chamber 31 and the second output cylinder chamber 32. The output piston 33 moves to the right direction in the drawing when a working fluid is supplied to the first output cylinder chamber 31 and is discharged from the second output cylinder chamber 32. The output piston 33 moves to the left direction in the drawing when the working fluid is supplied to the second output cylinder chamber 32 and is discharged from the first output cylinder chamber 31. For example, the working fluid is hydraulic oil.

The fluid pressure pump 2 has a first port 11 and a second port 12. The electric motor 1 drives the fluid pressure pump 2. When the electric motor 1 rotates to a first direction, the fluid pressure pump 2 discharges from the first port 11, the working fluid suctioned from the second port 12. When the electric motor 1 rotates to a second direction opposite to the first direction, the fluid pressure pump 2 discharges from the second port 12, the working fluid suctioned from the first port 11. That is, one of the first port 11 and the second port 12 functions as a suction port and the other thereof functions as a discharge port. When the rotation direction of the electric motor 1 changes, the suction port and the discharge port are switched.

The first output cylinder passage 7 connects the first port 11 and the first output cylinder chamber 31. The second output cylinder passage 8 connects the second port 12 and the second output cylinder chamber 32. The working fluid leaked from the fluid pressure pump 2 is stored in an accumulator 4 connected with a return passage 6. The working fluid stored in the accumulator 4 is returned to the first output cylinder passage 7 through a check valve 5 when the pressure of the return passage 6 exceeds the pressure of the first output cylinder passage 7. The working fluid stored in the accumulator 4 is returned to the second output cylinder passage 8 through another check valve 5 when the pressure of the return passage 6 exceeds the pressure of the second output cylinder passage 8.

Figure 2:
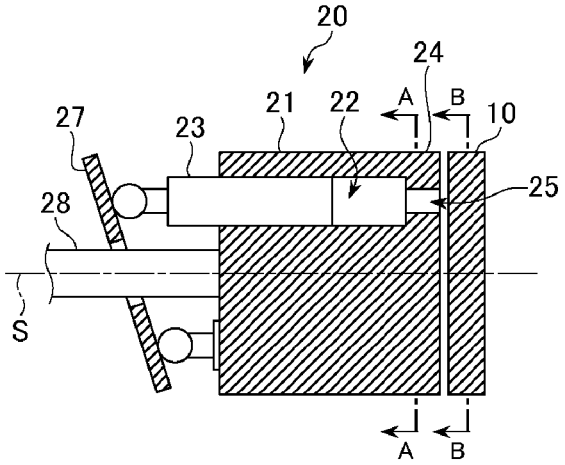
FIG. 2 is a diagram showing the outline of the fluid pressure pump in the first embodiment.

Referring to FIG. 2, the fluid pressure pump 2 has a port plate 10 and a piston unit 20. The port plate 10 is fixed and the piston unit 20 is supported to be rotatable. The first port 11 and the second port 12 are formed in the port plate 10. The piston unit 20 has a barrel 21, a plurality of pistons 23, a valve plate 24, a swash plate 27 and a shaft 28. A plurality of cylinders 22 are formed in the barrel 21. The plurality of cylinders 22 are arranged on a circumference around a rotation axis S in an equal interval. The plurality of pistons 23 are arranged to be reciprocatable in parallel to the rotation axis S in the plurality of cylinders 22, respectively. The positions of the plurality of pistons 23 in the direction parallel to the rotation axis S are determined by the swash plate 27. A plurality of valve plate holes 25 are formed in the valve plate 24 to be respectively connected with the plurality of cylinders 22. The valve plate 24 is arranged to overlap with the port plate 10. The shaft 28 is connected with the electric motor 1. The electric motor 1 rotates the piston unit 20 around the rotation axis S with respect to the port plate 10. When the swash plate 27 leans with respect to the rotation axis S, each of the plurality of pistons 23 carries out a reciprocating motion in a corresponding one of the plurality of cylinders 22 in synchronization with the rotation of the piston unit 20. The capacity of cylinder 22 increases and decreased through the reciprocating motion of the piston 23. When the electric motor 1 is rotating to the first direction, the first port 11 overlaps with the valve plate hole 25 connected with the cylinder 22 whose capacity is decreasing (i.e. which is discharging the working fluid), and the second port 12 overlaps with the valve plate hole 25 connected with the cylinder 22 whose capacity is increasing (i.e. which is suctioning the working fluid). When the electric motor 1 is rotating to the second direction, the first port 11 overlaps with the valve plate hole 25 connected with the cylinder 22 whose capacity is increasing (i.e. which is suctioning the working fluid), and the second port 12 overlaps with the valve plate hole 25 connected with the cylinder 22 whose capacity is decreasing (i.e. which is discharging the working fluid). When the inclination of the swash plate 27 is changed, a discharge capacity of the fluid pressure pump 2 changes.

Figure 3:
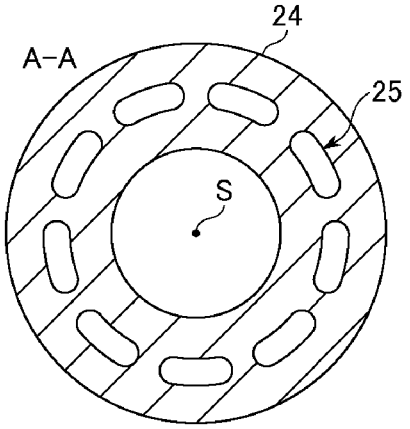
FIG. 3 is a sectional view showing a valve plate of the fluid pressure pump according to the first embodiment.

Referring to FIG. 3, the plurality of valve plate holes 25 are formed in the valve plate 24 to be arranged on the circumference around the rotation axis S in an equal interval. In this embodiment, a case where the number of cylinders 22 and the number of pistons 23 are nine will be described. However, the numbers of the valve plate holes 25, the cylinders 22 and the pistons 23 are not limited to nine.

Figure 4:
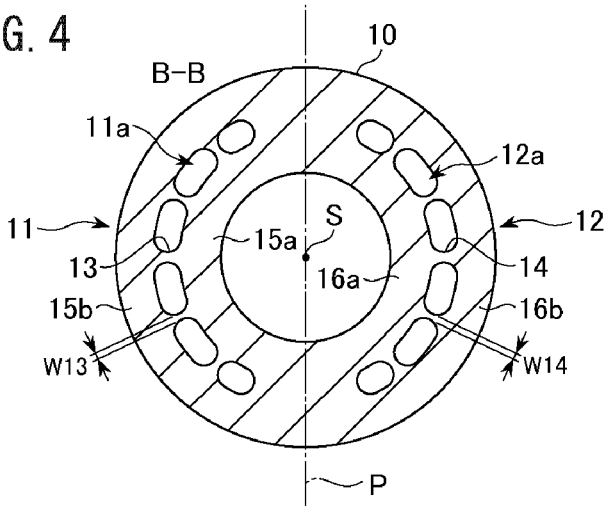
FIG. 4 is a sectional view showing a port plate of the fluid pressure pump according to the first embodiment.

Referring to FIG. 4, each of the first port 11 and the second port 12 which are formed in the port plate 10 is formed to have an arc shape around the rotation axis S. The first port 11 and the second port 12 are symmetrically formed with respect to a symmetry plane P which contains the rotation axis S. The first port 11 and the second port 12 are separated from each other so that one valve plate hole 25 does not overlap with the first port 11 and the second port 12 at the same time. The port plate 10 includes an inner portion 15*a* on an inner side of the first port 11, an outer portion 15*b* on an outer side of the first port 11, a plurality of bridges 13 which connect the inner portion 15*a* and the outer portion 15*b*, an inner portion 16*a* on an inner side of the second port 12, an outer portion 16*b* on an outer side of the second port 12, and a plurality of bridges 14 which connects the inner portion 16*a* and the outer portion 16*b*. The width of the bridge 13 in the circumferential direction is shown by a symbol W13 and the width of the bridge 14 in the circumferential direction is shown by a symbol W14. The plurality of bridges 13 divide the first port 11 into the circumferential direction to form a plurality of first port holes 11*a*. The plurality of bridges 14 divide the second port 12 into the circumferential direction to form a plurality of second port holes 12*a*. It can be prevented by the plurality of bridges 13 that the distance between the inner portion 15*a* and the outer portion 15*b* is increased due to the pressure of the working fluid which passes the first port 11. It can be prevented by the plurality of bridges 14 that the distance between the inner portion 16*a* and the outer portion 16*b* is increased due to the pressure of the working fluid which passes the second port 12.

Note that in the present embodiment, a case where the number of brides 13 and the number of bridges 14 are both 5, and the number of first port holes 11*a* and the number of second port holes 12*a* are both 6 will be described. However, the number of bridges 13 and the number of bridges 14 are not limited to 5 and the number of first port holes 11*a* and the number of second port holes 12*a* are not limited to 6.

Figure 5:
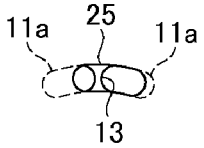
FIG. 5 is a diagram schematically showing the overlapping state of the valve plate hole and the bridge.

Referring to FIG. 5, the valve plate hole 25 and the bridge 13 overlap, depending on the rotation angle between the port plate 10 and the valve plate 24. When the valve plate hole 25 and the bridge 13 overlap, the opening area between the port plate 10 and the valve plate 24 decreases. Therefore, the bridge 13 causes a pressure loss in the fluid pressure pump 2. In the same way, the bridge 14 causes the pressure loss in the fluid pressure pump 2.

In the present embodiment, the number of bridges 13 and the number of bridges 14 are determined such that a summation of the number of first port holes 11*a* and the number of second port holes 12*a* is more than the number of valve plate holes 25. In a general axial piston type fluid pressure pump, because the number of valve plate holes often is seven or nine, it is desirable that each of the number of bridges 13 and the number of bridges 14 is equal to or more than three. Because the number of bridges 13 and the number of bridges 14 are more, the necessary strength of the port plate 10 is secured even if the width W13 of bridge 13 and the width W14 of bridge 14 are narrow. It can be prevented that the distance between the inner portion 15*a* and the outer portion 15*b* is increased due to the pressure of working fluid, and it can be prevented that the distance between the inner portion 16*a* and the outer portion 16*b* is increased due to the pressure of the working fluid. By narrowing the width W13 and the width W14, the pressure loss in the fluid pressure pump 2 is reduced.

Here, it is supposed that an optional one of the plurality of valve plate holes 25 is referred to as an optional valve plate hole 25. A first area as an area of the plurality of bridges 13 which overlaps with the optional valve plate hole 25 in a view parallel to the rotation axis S changes according to a relative rotation of the piston unit 20 and the port plate 10 around the rotation axis S. Also, a second area as an area of the plurality of bridges 14 which overlaps with the optional valve plate hole 25 changes according to the relative rotation. In the present embodiment, the quotient when the maximum value of the first area is divided by the area of the optional valve plate hole 25 and the quotient when the maximum value of the second area is divided by the area of the optional valve plate hole 25 are smaller than 0.65. Because the quotient when the maximum value of the first area or the second area is divided by the area of the optional valve plate hole 25 is small, the pressure loss in the fluid pressure pump 2 is reduced.

Hereinafter, the pressure loss in the fluid pressure pump 2 according to the present embodiment is compared with the pressure loss in the fluid pressure pump according to a comparison example, in order to explain the reduction effect of pressure loss in the present embodiment.

Figure 6:
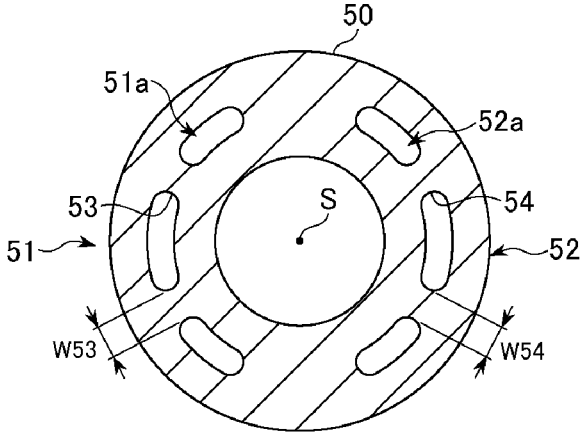
FIG. 6 is a sectional view showing the port plate of a fluid pressure pump in a comparison example.

Referring to FIG. 6, the fluid pressure pump according to comparison example is configured in the same way as the fluid pressure pump 2 according to the present embodiment, except for the point that the port plate 10 is replaced by the port plate 50. A first port 51 and a second port 52 which are respectively equivalent to the first port 11 and the second port 12 are formed in the port plate 50. The first port 51 and the second port 52 are formed to have an arc shape around the rotation axis S. The port plate 50 includes a plurality of bridges 53 by which the first port 51 is divided into the circumferential direction to form a plurality of first port holes 51*a*, and a plurality of bridges 54 by which the second port 52 is divided into the circumferential direction to form the plurality of second port holes 52*a*. The width of the bridge 53 in the circumferential direction is shown by a symbol W53 and the width of the bridge 54 in the circumferential direction is shown by a symbol W54. In this comparison example, the number of bridges 53 and the number of bridges 54 are two respectively, and the number of first port holes 51*a* and the number of second port holes 52*a* are three respectively. Because the number of bridges 53 and the number of bridges 54 are less than the number of bridges 13 and the number of bridges 14, the width W53 and the width W54 need to be made wider than the width W13 and the width W14.

Figure 7:
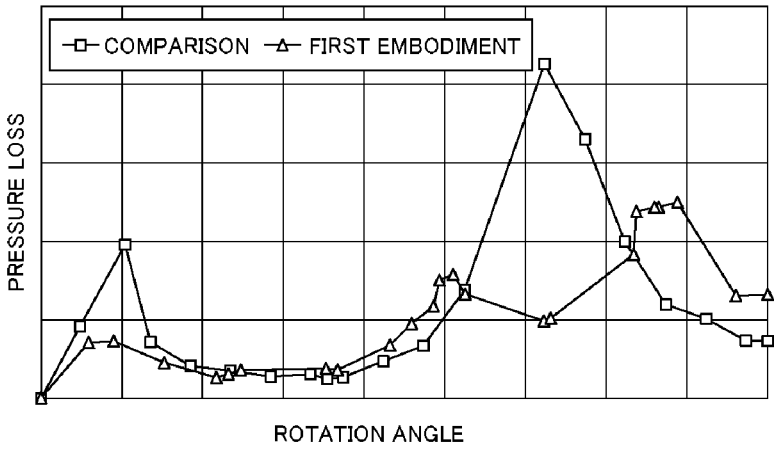
FIG. 7 is a diagram showing a relation between pressure loss and rotation angle in the fluid pressure pump according to the first embodiment and the fluid pressure pump according to the comparison example.

FIG. 7 is a diagram showing a relation between the pressure loss of the fluid pressure pump according to the comparison example and the fluid pressure pump 2 according to the present embodiment and the rotation angle to the port plate 10 or 50 of the piston unit 20. The vertical axis shows pressure loss and the horizontal axis shows rotation angle. The maximum value of the pressure loss in the fluid pressure pump 2 according to the present embodiment is small, as compared with the maximum value of the pressure loss in the fluid pressure pump according to comparison example. As shown in FIG. 7, in the fluid pressure pump 2 according to the present embodiment, the pressure loss is reduced.

Because the pressure loss is reduced in the fluid pressure pump 2, it is not required to increase the discharge pressure of the fluid pressure pump 2 so as to make up the pressure loss. Therefore, it is possible to manufacture the fluid pressure pump 2 in a small size and it is possible to manufacture the fluid pressure actuator 100 having the fluid pressure pump 2, in a small size.

Note that when the fluid pressure pump 2 is applied to EHA (Electro-Hydrostatic Actuator), it is desirable that the first port 11 and the second port 12 are symmetrically formed with respect to a symmetry plane P which contains the rotation axis S, in order to switch an suction port and a discharge port between the first port 11 and the second port 12. That is, it is desirable that the number of first port holes 11*a* is equal to the number of second port holes 12*a*. It is desirable that the quotient when the maximum value of the area of the plurality of bridges 13 which overlaps with the optional valve plate hole 25 is divided by the area of the optional valve plate hole 25 is equal to the quotient when the maximum value of the area of the plurality of bridges 14 which overlaps with the optional valve plate hole 25 is divided by the area of the optional valve plate hole 25, in a view parallel to the rotation axis S.

As described above, the fluid pressure pump according to the present invention has been described with reference to the embodiments. However, the fluid pressure pump according to the present invention is not limited to the above embodiments. For example, a modification may be applied to the above embodiments and the above embodiments may be combined. For example, when one of the first port 11 and the second port 12 is fixedly used as the suction port and the other is fixedly used as the discharge port, the first port 11 and the second port 12 needs not to be symmetrically formed with respect to the symmetry plane P which contains the rotation axis S.

The invention claimed is:

1. A fluid pressure pump for a fluid, the fluid pressure pump comprising:

a fixed port plate having a first port and a second port, one of which functions as a suction port and the other of which functions as a discharge port; and a piston unit configured to rotate around a rotation axis with respect to said fixed port plate, wherein said piston unit comprises:

a swash plate;

a barrel coaxial with the rotation axis, rotatable around the rotation axis and having a plurality of cylinders extending parallel to the rotation axis;

a plurality of pistons disposed in said plurality of cylinders to come into contact with said swash plate and to carry out a reciprocating motion due to said swash plate when said piston unit is rotated around the rotation axis; and a rotating valve plate having a plurality of valve plate holes formed to be respectively connected with said plurality of cylinders, wherein said plurality of valve plate holes are arranged at even intervals on a circumference around the rotation axis, wherein each of said first port and said second port is formed to have an arc shape on the circumference around the rotation axis, wherein said first port and said second port are separated from each other such that each of said plurality of valve plate holes does not overlap said first port and said second port at a same time, wherein said fixed port plate comprises:

a plurality of first bridges disposed to divide said first port on the circumference to provide at least five first port holes which are arranged in a series; and a plurality of second bridges configured to divide said second port on the circumference to provide at least five second port holes which are arranged in a series, wherein a summation of a number of said plurality of first port holes and a number of said plurality of second port holes is greater than a number of said plurality of valve plate holes, wherein a suction process and a discharge process are carried out once in a relative single revolution of said piston unit, and wherein said piston unit is configured to rotate around the rotation axis with respect to said fixed port plate in a first direction such that said first port of said fixed port plate suctions in the fluid and said second port of said fixed port plate discharges the fluid, and configured to rotate around the rotation axis with respect to said fixed port plate in a second direction that is opposite the first direction such that said first port of said fixed port plate discharges the fluid and said second port of said fixed port plate suctions the fluid.

2. The fluid pressure pump according to claim 1, wherein the number of said plurality of first port holes and the number of said plurality of second port holes are equal to each other.

3. The fluid pressure pump according to claim 1, wherein an optional one of said plurality of valve plate holes is referred to as an optional valve plate hole, wherein a first area as an area of said plurality of first bridges which overlaps with said optional valve plate hole changes based on the relative rotation of said piston unit and said fixed port plate around the rotation axis, and a second area as an area of said plurality of second bridges which overlaps with said optional valve plate hole changes based on the relative rotation, and wherein a quotient when a maximum value of the first area is divided by the area of said optional valve plate hole and a quotient when a maximum value of the second area divided by the area of said optional valve plate hole are both smaller than 0.65.

4. The fluid pressure pump according to claim 3, wherein the quotient when the maximum value of the first area is divided by the area of said optional valve plate hole and the quotient when the maximum value of the second area divided by the area of said optional valve plate hole are equal to each other.

* * * * *